United States Patent [19]

Sagawa

[11] Patent Number: 4,995,905

[45] Date of Patent: Feb. 26, 1991

[54] PERMANENT MAGNET HAVING IMPROVED HEAT-TREATMENT CHARACTERISTICS AND METHOD FOR PRODUCING THE SAME

[75] Inventor: Masato Sagawa, Kyoto, Japan

[73] Assignee: Masato Sagawa, Japan

[21] Appl. No.: 355,759

[22] Filed: May 23, 1989

[30] Foreign Application Priority Data

Oct. 6, 1988 [JP] Japan ..... 63-250851

[51] Int. Cl.[5] ..... C22C 29/14

[52] U.S. Cl. ..... 75/244; 75/246; 419/12; 419/29; 419/60; 148/302

[58] Field of Search ..... 75/244, 246, 245; 148/302; 420/83; 419/12, 29, 60

[56] References Cited

U.S. PATENT DOCUMENTS 4,684,406 9/1987 Matsuura et al. ..... 75/244
4,765,848 8/1988 Mohri et al. ..... 148/302
4,770,702 9/1988 Ishigaki et al. ..... 75/244
4,770,723 9/1988 Sagawa et al. ..... 148/302
4,773,950 9/1988 Fujimura et al. ..... 148/302

FOREIGN PATENT DOCUMENTS 64704 1/1989 Japan .

*Primary Examiner*—Stephen J. Lechert, Jr.
*Assistant Examiner*—N. Bhat
*Attorney, Agent, or Firm*—Fish & Richardson

[57] ABSTRACT

When V is added to an Nd—Fe—B sintered magnet so as to modify the minority phase such that B in excess of a stoichiometric composition of $R_2Fe_{14}B$ compound-phase, essentially does not form $RFe_4B_4$-compound minority phases but forms a finely dispersed V—T—B compound minority phase (T is Fe, and in a case containing Co, T is Fe and Co), the coercive force (iHc) is enhanced to 15 kOe or more but becomes very sensitive to heat treatment temperature. This drawback is eliminated by the addition of from 0.01 to 1 at % of Cu.

16 Claims, 4 Drawing Sheets

PERMANENT MAGNET HAVING IMPROVED HEAT-TREATMENT CHARACTERISTICS AND METHOD FOR PRODUCING THE SAME

BACKGROUND OF INVENTIION

1. Field of Invention

The present invention relates to a permanent magnet, more particularly an Nd—Fe—B sintered magnet, and to a method for producing the same.

In the Nd—Fe—B magnets there are melt-quenched magnets and sintered magnets. Essentially, the melt-quenched magnet is magnetically isotropic. There is a method under proposal for rendering the melt-quenched magnet anisotropic, which resides in crushing a strip obtained by melt-quenching to produce a powder, hot-pressing and then die-upsetting the powder. This method, however, has not yet been carried out industrially, since the production steps are complicated.

2. Description of Related Arts

Nd—Fe—B sintered magnet has been developed by the present inventor et al. It has outstanding characteristics in that it exhihits excellent magnetic property in terms of 50 MGOe of maximum energy product (BH)max in a laboratory scale and 40 MGOe even in a mass production scale; and, the cost of raw materials is remarkably cheaper than those of the rare-earth cobalt magnet, since the main components are Fe and B, and Nd (neodymium) and Pr (praseodymium), all inexpensive elements, which are relatively abundant in the rare-earth elements. Representative patents of the Nd—Fe—B sintered magnet are Japanese Unexamined Patent Publication No. 59-89401, Japanese Unexamined Patent Publication No. 59-46008 (Japanese Examined Patent Publication No. 61-34242, Japanese Patent No. 14316170), Japanese Unexamined Patent Publication No. 59-17003), USP No.4597938 and European Patent No. EP-A-0101552. As for academic papers, there is "New Material for permanent magnets on a base of Nd and Fe (invited)", M. Sagawa et al, J. Appl. Phys., 55, No.6, Part II, p 2083/2087 (March, 1984).

The present applicant filed a patent application U.S. Ser. No. 07/321,183 directed to the following magnets (A) and (B), below. The description of prior art in this earlier patent application is referred hereinto.

The present inventor researched and discovered the following. That is, in a V-added Nd—Fe—B magnet having a specified composition, the $NdFe_4B_4$ phase (B rich phase) is suppressed to the minimum amount, and a compound phase other than the $NdFe_4B_4$ phase, i.e., a V—Fe—B compound phase, whose presence is heretofore unknown, is formed and replaces the $NdFe_4B_4$ phase, i.e., B rich phase. An absolute value of the coercive force (iHc) is exceedingly enhanced and the stability at high temperature is improved due to the functions of both V—Fe—B compound phase and the particular composition. In addition, the corrosion resistance of the Nd—Fe—B sintered magnet is greatly improved by the formation of the V—Fe—B compound phase and disappearance or decrease of the $NdFe_4B_4$ phase.

Based on such a discovery, the invention of the earlier application was made.

(A) An R—Fe—B sintered magnet has a temperature-coefficient of coercive force (iHc) of 0.5%/° C. or more, and such a composition that R=11-18 at % (R is one or more rare-earth elements excluding Dy, with the proviso that 80 at % (Nd+Pr)/R 100 at %), B=6-12 at %, and the balance is Fe and Co (with the proviso that Co is 25 at % or less relative to the total of Co and Fe (including 0% of Co)) and impurities. Also it is characterized in that B, in excess of a stoichiometric composition of a $R_2Fe_{14}B_4$ compound-phase, essentially does not form a $RFe_4B_4$-compound minority phase but forms a finely dispersed V—T—B compound minority phase (T is Fe, and in a case containing Co, T is Fe and Co), and, further, the magnet exhibits 20 MGOe or more of maximum energy product and 15 kOe or more of coercive force (iHc).

(B) An R—Fe—B sintered magnet has a temperature-coefficient of coercive force (iHc) of 0.5%/°C. or more and such a composition that R=11-18 at % (R is rare-earth elements, $R_1$=Nd+Pr, $R_2$=Dy, with the proviso that 80 at % $\leqq (R_1+R_2)/R \leqq$ 100 at %), $0 \leqq R_2 \leqq 4$ at %, B=6-12 at %, and the balance is Fe aad Co (with the proviso that Co is 25 at % or less relative to the total of Co and Fe (including 0% of Co)) and impurities. Also it is characterized in that B, in excess of a stoichiometric composition of $R_2Fe_{14}B$ compound-phase, essentially does not form a $RFe_4B_4$-compound minority phase but forms a finely dispersed V—T—B compound minority phase (T is Fe, and in a case containing Co, T is Fe and Co), and, further, the magnet exhibits 20 MGOe or more of maximum energy product and 15+3x (kOe) of coercive force (iHc) (x is Dy content (at %), with the proviso that when 15+3x (kOe) is 21 kOe or more, the coercive force is 21 kOe or more).

SUMMARY OF THE INVENTION

Subsequent study of the V-added Nd—Fe—B sintered magnet disclosed in the earlier application, revealed that although a high coercive force (iHc) is obtained, a problem is involved in the heat treatment. Namely, the coercive force (iHc) is very sensitive to the heat treatment temperature, and, in addition, the temperature range, where the peak value of the coercive is force (iHc) is obtained, is extremely narrow.

More specifically, when a number of permanent magnets are heat treated in a furnace, only some of them are heat treated at an optimum temperature because the furnace generally has an uneven temperature distribution. The majority of the magnets are therefore cooled while not attaining the optimum temperature, or they are held at a temperature higher than the optimum temperature and merely pass through the optimum temperature during cooling from the holding temperature. Since the coercive force (iHc) is extremely sensitive to the heat treatment temperature, the coercive force (iHc) drastically decreases at a holding temperature slightly lower than the optimum temperature. This means that, even if a permanent magnet is held at the optimum temperature, when transit time in such a lower temperature range exceeds a certain level, the coercive force (iHc) drastically decreases. In order to avoid this, water cooling must be carried out so as to rapidly cool a permanet magnet in such low temperature range in which the deterioration of coercive force (iHc) is likey to occur. Meanwhile, in the case of a large sized magnet, water cooling causes the generation of cracks which decreases the production yield. Since the Nd—Fe—B sintered magnet is frequently used for a large sized magnet, the problem of crack generation is serious.

It is therefore an object of the present invention to improve the heat-treatment characteristics of the Nd—

Fe—B sintered magnet disclosed in the earlier application.

It is another object of the present invention to provide a method for producing an Nd—Fe—B sintered magnet having improved heat-treatment characteristics.

In accordance with the object of the present invention, there is provided an R—Fe—B sintered magnet, which has a composition such that R=11-18 at % (R is one or more rare-earth elements, excluding Dy, with the proviso that 80 at %≦(Nd+Pr)/R≦100 at %), B=6-12 at %, and balance is Fe and Co (with the proviso of Co is 25 at % or less relative to the total of Co and Fe (including 0% of Co)) and impurities, and is characterized in that: Cu in an amount of from 0.01 to 1 at % is further contained; a V—T—B compound minority phase (T is Fe, and in a case containing Co, T is Fe and Co) is finely dispersed: and, further, the magnet exhibits 20 MGOe or more of maximum energy product and 15 kOe or more of coercive force (iHc), as well as improved heat-treatment characteristics.

There is also provided an R—Fe—B sintered magnet, which has a composition such that R=11-18 at % (R is rare-earth elements, $R_1$=Nd+Pr, $R_2$=Dy, with the proviso of 80 at % ≦($R_1$+$R_2$)/R≦100 at %), 0<$R_2$≦4 at %, B=6-12 at %, and the balance of Fe and Co (with the proviso that Co is 25 at % or less relative to the total of Co and Fe (including 0% of Co)) and impurities, and is characterized in that: Cu in an amount of from 0.01 to 1 at % is further contained; a V—T—B compound minority phase (T is Fe, and in a case containing Co, T is Fe and Co) is finely dispersed; and, the magnet exhibits 20 MGOe or more of maximum energy product and ≧15+3x (kOe) of coercive force (iHc) (x is Dy content (at %), with the proviso that when 15+x (kOe) is 21 kOe or more, the coercive force is 21 kOe or more), as well as improved heat-treatment characteristics.

As a method for producing an R—Fe—B sintered magnet which consists of the structure of $R_2Fe_{14}B$ compound-phase and V—T—B compound phase, and which has ≧15+3x (kOe) (x=Dy content (at %)) of the coercive force (iHc), said method comprising a sintering step and a subsequent sitering step, the present invention is characterized in that the composition of R—Fe—B magnet is R=11-18 at % (R is: (a) one or more rare-earth elements excluding Dy, with the proviso that 80 at %≦(Nd+pr)/R≦100 at %; or (b) rare-earth elements, $R_1$=Nd+Pr, $R_2$=Dy, with the proviso of 80 at %≦($R_1$+$R_2$)/R≦100 at %), B=6-12 at %, V=2-6 at %, Cu=0.01-1 at %, and the balance of Fe and Co (with the proviso that Co is 25 at % or less relative to the total of Co and Fe (including 0% or Co)) and impurities.

The present invention is hereinafter described with reference to the drawings.

BRIEF DESCRIPTION OF DRAWINGS

FIG. 2 is an EPMA (electron probe micro-analysis) photograph of an Nd—Fe—B sintered magnet.

FIG. 3(A) and FIG. 3(B) show the electron diffraction of V—Fe—B compound.

FIG. 4 shows the transmission-electron micrograph of an Nd—Fe—B sintered magnet.

DESCRIPTION OF PREFERRED EMBODIMENTS

Figure 1:
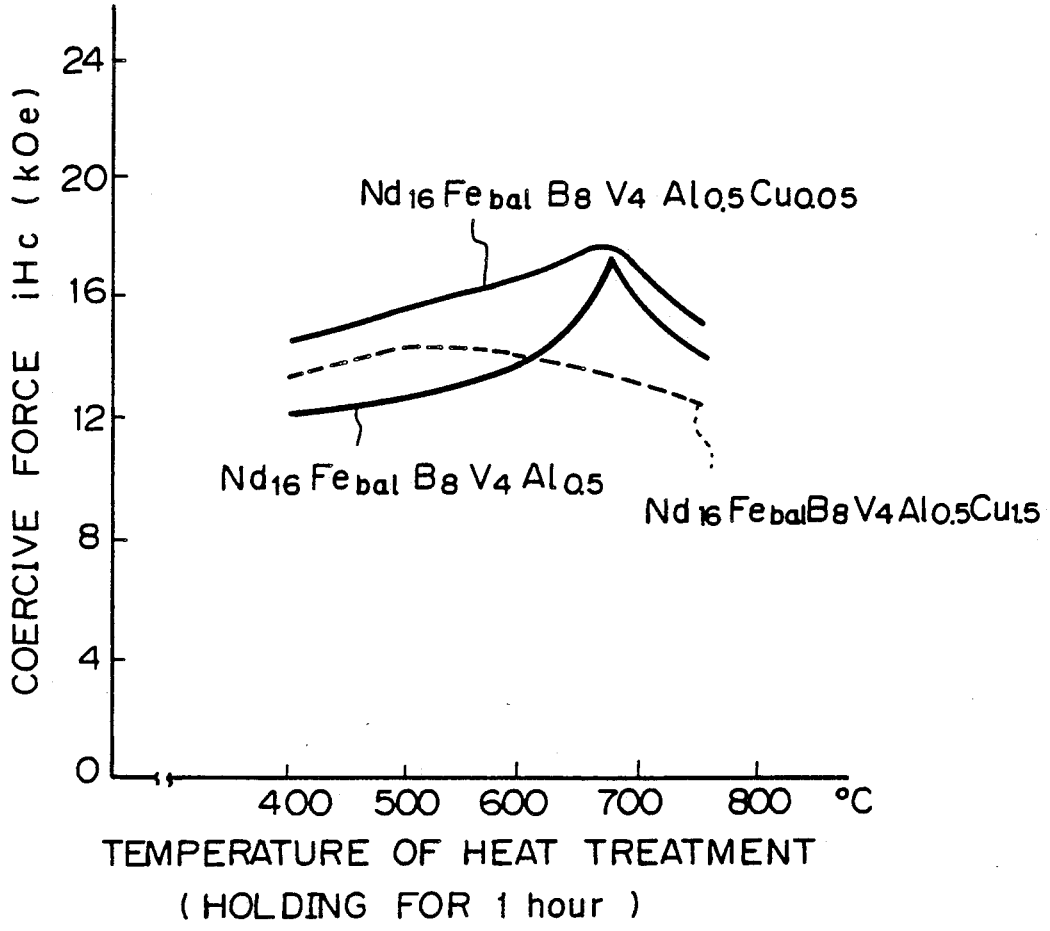
FIG. 1 is a graph illustrating the dependence of coercive force (iHc) upon the heat-treatment temperature.

The structure of an R—Fe—B sintered magnet, which may hereinafter be referred to as the Nd—Fe—B magnet, according to the present invention is first described.

The V—T—B compound (phase) may be hereinafter referred to as V—Fe—B compound (phase).

The V—Fe—B compound phase is formed in the constitutional structure of a sintered body, as long as Nd, Pr, (Dy), B, Fe and V are within the above described ranges.

When the R content is less than the above range, α-Fe is formed. On the other hand when the R content is more than the above range, an Nd rich phase is formed and the residual magnetization is lessened. When the B content is less than the above range, a large amount of $R_2Fe_{17}$ is formed and hence V—T—B compound is unlikely to form. On the other hand, when the B content is more than the above range, a large amount of the $RFe_4B_4$ phase is formed. When the V content is less than the above range, the amount of V—T—B compound formed is very small. On the other hand, when the V content is more than the above range, the amount of V—T—B compound formed is too great to attain high coercive force (iHc) and residual magnetization (Br).

The V—Fe—B compound phase in the sample of No.1 in Table 1 described below, as a result of the EPMA measurement, turned out to have a composition of 29.5 at % of V, 24.5 at % of Fe, 46 at % of B, and a trace of Nd. The V—Fe—B compound, as a result of electron diffraction, turned out to have a unit cell of tetragonal structure having lattice constants of a=5.6 Å and c=3.1 Å. An electron diffraction-photograph used for analysis of the crystal structure of V—Fe—B compound is shown in FIGS. 3(A) and (B). For identification of the crystal structure, it is now compared with those of already known compounds. At present, tetragonal $V_3B_2$ is the most probable. Presumably, a part of V of this compound is replaced with Fe. Elements other than the above is mentioned can be dissolved in a solid solution of that compound. Depending upon the composition, additive elements, and impurities of sintered bodies, V of that compound can be replaced with various elements having properties similar to V. B of that compound can be replaced with C which has properties similar to B. Even in these cases, an improved coercive force (iHc) is obtained, as long as the sintered magnet includes a binary V—B compound, the part of which is replaced with Fe (possibly, $(V_{1-x}Fe_x)_3B_2$ phase) and is occasionally additionally replaced with Co and the M elements described hereinbelow. The B rich phase, which is contained in most of the conventional Nd—Fe—B magnets, is gradually lessened and finally becomes zero with the increase in the amount formed of the V—Fe—B compound, in which virtually no, or very little Nd is dissolved as a solid solution, the remainder of Nd constitutes the Nd rich phase, which is essential for the liquid-phase sintering, with the result that Nd is effectively used for improving the magnetic properties. That is, the Nd—Fe—B magnet according to the present invention, which is essentially free of the B rich phase, exhibits a higher coercive force (iHc) than the conventional Nd—Fe—B magnet having the same composition as the former magnet and containing more B than the stoichiometric composition of $R_2Fe_{14}B$. The excess boron in an amount greater than the stoichiometric composition of $R_2Fe_{14}B$ means the surplus B which is greater than (1/17)x100 at %=5.8 at %. The excess boron is therefore 2.2 at % in the case of, for example Nd—Fe—B magnet containing 8 at % of B.

In an Nd—Fe—B magnet, whose coercive force (iHc) is significantly improved, the B rich phase is completely inappreciable or extremely slight even if partially appreciable. As is shown in the EPMA image of FIG. 2, the V—Fe—B compound phases dispersed in the grain boundaries and triple points of the grain boundaries of $R_2Fe_{14}B$ compound-phase. By observation with an electron microscope with a high resolving power, it turned out, as shown in FIG. 4, that finer V—Fe—B compound phases dispersed mainly at the grain boundaries and partly in the grains. The properties of the Nd—Fe—B magnet are better in the case where the V—Fe—B compound phase is dispersed mainly in the grain boundaries, than in the case where the V—Fe—B compound phase is dispersed mainly within the grains. Ideally, almost all of the crystal grains of the $R_2Fe_{14}B$ compound-phase are in contact at their boundaries with a few or more of the particles of the V—Fe—B compound phase.

Although FIGS. 2, 3 and 4 relate to the structure of V-added Nd—Fe—B magnet which is free from Cu, the above descriptions with reference to these drawings are also applied to the V-added Nd—Fe—B magnet containing Cu.

The coercive force (iHc) of the Nd—Fe—B magnet according to claim 1 is 15 kOe or more. Since the coercive force (iHc) is enhanced by 3 kOe by addition of 1 at % of Dy at room temperature, the coercive force (iHc) at room temperature is $\geqq 15+3x$ (kOe) (x is Dy content by atomic %) in an Nd—Fe—B magnet, in which Dy is added. However, since the applied maximum magnetic field of an electromagnet used in experiments for measuring the demagnetizing curves until the completion of the present invention was 21 kOe, actual values could not be measured when the coercive force (iHc) exceeded 21 kOe. Therefore, when the coercive force (iHc), calculated according to the above formula exceeds 21 kOe, the inventive coercive force (iHc) is set at at least 21 kOe or more. The coercive force (iHc) at 140° C. is enhanced by 2 kOe by addition of 1 at % of Dy.

One standard, which is necessary for using the Nd—Fe—B magnet at a high temperature, is 5 kOe or more of the coercive force (iHc). Now consideration is been given to cases where the temperature increases to 140° C., as frequently seen when magnets are used for motors and the like. If the temperature-coefficient of the coercive force (iHc) is, for example, 0.5%/°C., the coercive force (iHc) at room temperature must be 12.5 kOe or more. The compositional range according to claim 1 fulfills this value for the coercive force (iHc). If the temperature-coefficient of the coercive force (iHc) is, for example, 0.6%/°C., the coercive force (iHc) at room temperature must be 17.8 kOe or more. This value of coercive force (iHc) is fulfilled by a compositional range according to claim 1 except in the vicinities of the upper and lower limits, provided that aluminum is the composition of claim 1. When the temperature coefficient of the coercive force (iHc) is 0.7%/°C. or more, 5 kOe or more of the coercive force (iHc) is obtained at 140° C. by a composition with a Dy addition. A coercive force (iHc) at 200° C. amounting to 5 kOe or more is obtained by a composition containing 3—approximately 5.5 at % of V, 13 at % or more of R, more than 1 at % of Dy and an aluminum addition.

Since the Nd—Fe—B magnet as described above has a temperature sensitivity of heat treatment, the coercive force (iHc) in proximity of the peak value is obtained by heat treating in a very narrow temperature range of heat treatment, as given in Table 1, followed by water cooling.

TABLE 1

| Nos. | Composition (at %) Nd | Pr | Dy | V | Al | B | Co | M | Fe | iHc (max) (kOe) | Range of Heat Treatment (°C.) min-max | (BH) max (MGOe) |
|---|---|---|---|---|---|---|---|---|---|---|---|---|
| 1 | 16 | — | — | 4 | 0.5 | 8 | — | — | bal | 17.3 | 670-680 | 31.1 |
| 2 | 16 | — | 0.5 | 4 | 0.5 | 8 | — | — | bal | 18.6 | 670 | 30.0 |
| 3 | 16 | 1.5 | — | 3 | 0.7 | 9 | — | — | bal | 17.5 | 650-660 | 30.1 |
| 4 | 16 | — | — | 4 | 1.2 | 8 | 4 | — | bal | 16.9 | 600 | 26.3 |
| 5 | 15 | — | — | 3 | — | 8 | — | Cr = 1 | bal | 16.5 | 640-650 | 28.3 |
| 6 | 15 | — | — | 3 | — | 8 | — | Mo = 1 | bal | 16.8 | 650-660 | 29.0 |
| 7 | 15 | — | — | 3 | — | 8 | — | W = 1 | bal | 16.5 | 650-660 | 29.1 |
| 8 | 15 | — | — | 4 | — | 8 | — | Hf = 1 | bal | 16.9 | 640 | 29.6 |

In Table 1, the range of heat treatment indicates the temperature range, in which a coercive force (iHc) lower than the maximum coercive force (iHc) by 1 kOe is obtained. If not specified, aluminum is contained as an impurity. The holding time at the heat treating temperature is 1 hour (also in Table 2). The range of heat treatment is 10° C. or less and hence very It is understood from the following Table 2 that by means of adding a small amount of Cu to the V-added Nd—Fe—B magnet, the temperature range of heat treatment for obtaining a high coercive force is greatly broadened. It is very important in the mass production of sintered magnets that the temperature range of heat treatment be broad. When the Cu content is less than 0.01 at %, Cu is merely an impurity and is not particlularly effective. On the other hand, when the Cu content exceeds 1 at %, the coercive force (iHc) decreases.

TABLE 2

| No. | Composition (at %) (max) Nd | Pr | Dy | V | Al | B | Co | M | Cu | Fe | iHc range (kOe) | H.T. (BH) max (°C.) | (MGOe) |
|---|---|---|---|---|---|---|---|---|---|---|---|---|---|
| 1 | 16 | — | — | 4 | 0.5 | 8 | — | — | 0.05 | bal | 17.5 | 600~700 | 31.2 |

TABLE 2-continued

| No. | Composition (at %) (max) Nd | Pr | Dy | V | Al | B | Co | M | Cu | Fe | iHc range (kOe) | H.T. (BH) max (°C.) | (MGOe) |
|---|---|---|---|---|---|---|---|---|---|---|---|---|---|
| 2 | 16 | — | 0.5 | 4 | 0.5 | 8 | — | — | 0.1 | bal | 18.6 | 580~690 | 30.1 |
| 3 | 16 | 1.5 | — | 3 | 0.7 | 9 | — | — | 0.05 | bal | 17.8 | 590~680 | 30.0 |
| 4 | 16 | — | — | 4 | 1.2 | 8 | 5 | — | 0.05 | bal | 17.1 | 550~650 | 26.5 |
| 5 | 15 | — | — | 3 | — | 8 | — | Cr = 1 | 0.05 | bal | 16.9 | 580~680 | 28.9 |
| 6 | 15 | — | — | 3 | — | 8 | — | Mo = 1 | 0.15 | bal | 17.0 | 600~900 | 29.2 |
| 7 | 15 | — | — | 3 | — | 8 | — | W = 1 | 0.2 | bal | 16.8 | 600~900 | 29.3 |
| 8 | 15 | — | — | 4 | — | 8 | — | Hf = 0.05 | 0.1 | bal | 17.2 | 590~680 | 29.5 |
| 9* | 16 | — | — | 4 | 0.5 | 8 | — | — | 1.5 | bal | 15.0 | 400~700 | 28.5 |
| 10* | 15 | — | — | 3 | — | 8 | — | Cr = 1 | 1.4 | bal | 14.8 | 400~700 | 27.4 |
| 11* | 15 | — | — | 3 | — | 8 | — | Mo = 1 | 1.6 | bal | 14.9 | 400~700 | 26.2 |

Remarks. H.T. range = Range of heat treatment (°C.) max-min

In order to attain the effects of coercive force (iHc)—enhancement due to the V—T—B compound phase as described above, a powder of the raw materials must be carefully and uniformly mixed in the production process of sintered magnets, in which two or more kinds of fine particles are mixed with one another. Also in the production process, in which one kind of ingot is crushed to obtain a powder of desired composition, the phases must be uniformly and finely distributed in an ingot. In addition, subsequent to the milling step a uniform mixing step using a jet mill is necessary, so as to thoroughly and uniformly mix the powder which has previously been separated to the respective phases by another jet mill. Necessary length of time for uniformly mixing the powder is 30 minutes or more by using a rocking mixer.

An excellent coercive force is obtained by rapidly cooling after sintering during transit through the temperature range of from 800° to 700° C. If a satisfactory holding is not carried out at the optimum temperature in the heat treatment, reheating to a temperature of 800°-700° C., followed by rapid cooling should be carried out. This cancels the hysteresis due to such preceeding heat treatment, thereby making possible the subsequent optimum heat treatment.

When Al is added to the Nd—Fe—B magnet having the composition of Nd, Pr, (Dy), Fe, and Cu, the coercive force zs (iHc) is further enhanced. This is presumably because a small amount of Al promotes fine dispersion of the V—T—B compound phase.

Reasons for the limits on the compositions are as described above. In addition, if the contents are less than the lower limits, the coercive force (iHc) is reduced. On the other hand, if the contents are higher than the upper limits, the residual magnetization becomes low. With regard to Al, there are further detrimental effects which become serious at a content of more than 3 at % or more; that is, the Curie point is lower than 300° C., and a change of residual magnetization depending on the temperature, increases. Addition of V causes enhancement of the coercive force (iHc) but only slight decrease in the Curie point. When the amount of V is very high, since a detrimental $Nd_2Fe_{17}$ phase is formed, not only is the residual magnetization reduced but also the coercive force (iHc) is reduced, thus impairing stability at a high temperature. Nd and Pr are mainly used for the rare-earth elements (R), because both $Nd_2Fe_{14}B$ and $Pr_2Fe_{14}B$ have higher saturation magnetization together with higher uniaxial magnetic anisotropy than those of the $R_2Fe_{14}B$ compound-phase of the other rare-earth elements.

(Nd+Pr)/R is≧80 at %, because high saturation magnetization and high coercive force (iHc) are obtained by setting high contents of Nd and Pr, except for Dy. Dy enhances the coercive force (iHc) at 140° C. and 200° C. by approximately 2 kOe/% and 1 kOe/%, respectively. The content of Dy is 4 at % or less, because Dy is a rare resource and further, the residual magnetization is considerably lowered at more than 4 at %.

Incidentally, not only highly refined rare-earth elements but also mixed raw-materials, such as dydimium, in which Nd and Pr remain unseparated, and Ce-dydimium, in which Ce remains unseparated, can be used as the raw material for rare-earth elements.

Co, which may partly replace Fe, enhances the Curie point and improves the temperature-coefficient of residual magnetization. If, however, Co amounts to 25 at % or more of the total of Co and Fe, the coercive force (iHc) is lessened due to the minority phase described hereinafter. The amount of Co must therefore be 25 at % or less of the total of Co and Fe. In the Co-containing Nd—Fe—B magnet according to the present invention, $Nd_2Fe_{14}B$ compound and V—Fe—B compound are changed to $R_2(FeCo)_{14}B$ compound and V—(FeCo)—B compound, respectively. In addition, (Co.-Fe)—Nd phase generates as a new minority phase, which lowers the coercive force (iHc).

The present inventor added various elements to the above described Nd—Fe—B magnet and investigated influences of the additive elements on the coercive force (iHc). As a result, it turned out that the coercive force (iHc) is only slightly improved or is virtually unimproved, but does not not incur any decrease.

Like V, $M_1$ enhances the coercive force (iHc), but not as outstandingly as V does.

$M_2$ and $M_3$ have a slight effect of enhancing the coercive force (iHc). However, $M_2$ and $M_3$ may be incorporated in the refining process of rare-earth elements and Fe. It is advantageous therefore from the point of view of the cost of raw materials when the addition of $M_1$, $M_2$ and $M_3$ is permitted.

$M_1$=0–4 at % ($M_1$=one or more of Cr, Mo and W), $M_2$ =0–3 at % (one or more of Nb, Ta and Ni), and $M_3$=0–2 at % (one or more of Ti, Zr, Hf, Si and Mn).

Transition elements among the above elements replace a part of T of V—T—B compound. When the additional amount of $M_1$, $M_2$ and $M_3$ exceeds the upper limits, the Curie point and residual magnetization are lowered.

The elements other than the above described ones are impurities. Particularly, ferroboron, which is frequently used as the raw material of boron, contains aluminum. Aluminum also dissolves from a crucible. Aluminum is therefore contained in is 0.4 wt % (0.8 at %) at the maximum in the Nd—Fe—B magnet, even if aluminum is not added as an alloy element.

There are other elements which are reported to add to Nd—Fe—B magnet. For example, Ga is alleged to enhance the coercive force (iHc), when it is added together with cobalt. Ga can also be added in the Nd—Fe—B magnet of the present invention. Cu in an amount less than 0.01% is also an impurity. Oxygen is incorporated in the Nd—Fe—B sintered magnet during the alloy-pulverizing step, the post-pulverizing, pressing step, and the sintering step. In addition, a large amount of Ca is incorporated porated in the Nd—Fe—B magnet as the residue of the leaching step (rinsing step for separating CaO) of the co-reducing method for directly obtaining the alloy powder of Nd—Fe—B alloy by reduction with the use of Ca. Oxygen is incorporated in the Nd—Fe—B magnet in an amount of 10000 ppm (weight ratio) at the maximum. Such oxygen improves neither magnetic properties nor the other properties.

Into the Nd—Fe—B magnet are incorporated carbon from the raw materials of rare-earth and Fe—B, as well as carbon, phosphorus and sulfur irom the lubricant used in the pressing step. Under the present technique, carbon is incorporated in the Nd—Fe—B magnet in an amount of 5000 ppm (weight ratio) at the maximum. Also, this carbon improves neither the magnetic properties nor the other properties.

When Fe of the standard composition $Nd_{15}Fe_{77}B_5$ is replaced with 3.5 at % of V, the coercive force (iHc) is 15 kOe or more. This value is higher than 12 kOe of the coercive force (iHc) of the heat-treated standard composition by 3 kOe. Such enhancement of coercive force due to the V—T—B compound phase takes place presumably because the particles of such a phase suppress the grain growth during sintering and modify the grain boundaries such that nuclei of magnetization inversion generate in the grain boundaries with difficulty.

Referring to FIG. 1, heat treatment characteristics of the V-added Nd—Fe—B sintered magnet are illustrated with reference to an example of $Nd_{16}Fe_{bal}B_8V_4Al_{0.5}$. Namely, the peak value of the coercive force (iHc) is obtained in an extremely narrow temperature range of the heat treatment. As is shown in FIG. 1, is when Cu is added, significant reduction of the coercive force (iHc) from the peak value does not take place when the heat treatment temperature slightly deviates from the temperature where the peak value of the coercive force (iHc) is obtained. (This temperature is hereinafter referred to as the peak temperature.) Accordingly, a high coercive force (iHc) is obtained while tolerating a broad range of the holding temperature. In addition, since the reduction of coercive force (iHc) at a lower temperature side than the peak temperature is suppressed, the coercive force (iHc) is not reduced, and even the transit time in such lower temperature side becomes longer during cooling. As a result, a high coercive force (iHc) is obtained even at a slow cooling in the heat treatment. It is possible to prevent crack generation in a large sized magnet by employing a slow cooling. It is also possible to use a large scale furnace for heat treatment.

The maximum energy product of the inventive Nd—Fe—B sintered magnet is at least 20 MGOe, since this is the minimum value required for high-performance magnets, and, further a rare-earth magnet having lower value cannot compete with other magnets.

The present invention is hereinafter described with reference to the examples.

EXAMPLE 1

Alloys were melted in a high-frequency induction furnace and cast in an iron mold. As the starting materials the following (materials) were used: for Fe, an electrolytic iron having purity of 99.9 wt %; for B, a ferroboron alloy and boron having purity of 99 wt %; Pr having purity of 99 wt %; Dy having purity of 99 wt %; for V, a ferrovanadium containing 50 wt % of V; and, Al having purity of 99.9 wt %. Melt was stirred thoroughly during melting and casting so as to distribute V uniformly throughout the melt. The thickness of the ingots was made to 10 mm or less. This thickness is so thin as to carry out rapid cooling and to finely disperse the V—Fe—B compound phase in the ingots. The resultant ingots were pulverized by a stamp mill to 35 mesh. A fine pulverizing was then carried out by a jet mill with the use of nitrogen gas. As a result, a powder having a grain diameter of 2.5–3.5 μm was obtained. This powder was shaped under a pressure of 1.5 t/cm$^2$ and in the magnetic field of 10 kOe.

After the treatment by a jet mill, the powder was thoroughly stirred so as to uniformly and finely disperse the V—Fe—B compound in the sintered body.

The green compact obtained by pressing under the magnetic field was then sintered at 1050° to 1120° C. for 1 to 5 hours in an argon atmosphere.

The following compositions were prepared by the above procedure.

$Nd_{16}Fe_{bal}B_8V_4$ $Nd_{16}Fe_{bal}B_8V_4Cu_{0.05}$ $Nd_{16}Fe_{bal}B_8V_4Cu_{1.5}$ The temperature of the heat treatment was varied and the coercive force (iHc) was measured. The results are shown in FIG. 1. The following facts are apparent from FIG. 1. The maximum coercive force (iHc) of $Nd_{16}Fe_{bal}B_8V_4$ free of Cu exhibits a sharp peak. Temperature sensitivity of the coercive force (iHc) is considerably improved in the case of $Nd_{16}Fe_{bal}B_8V_4Cu_{0.05}$ with the addition of an appropriate amount of Cu. When too much Cu is added, as in the case of $Nd_{16}Fe_{bal}B_8V_4Cu_{1.5}$, the coercive force (iHc) is generally reduced.

EXAMPLE 2

Sheets 10×10×1 mm in size, having the compositions as given in Table 3, were prepared by the same method as Example 1. These sheets were heated to 80° C. in air having 90% of RH, up to 120 hours, and the weight increase by oxidation was measured. The results are shown in Table 3. It is apparent from Table 3 that the corrosion resistance is considerably improved by the addition of V.

TABLE 3

| No. | Nd | V | Al | B | Cu | Fe | Weight Increase by Oxidation (Δw) (mg/cm²) | iHc (kOe) | Proportion of V-T-B (%) |
|---|---|---|---|---|---|---|---|---|---|
| | Composition (at %) | | | | | | | | |
| 1* | 14 | — | — | 8 | — | bal | 0.68 | 12.5 | 0 |
| 2 | 14 | 2 | — | 8 | — | bal | 0.12 | 16.0 | 100 |
| 3 | 15 | 4 | — | 8 | 0.05 | bal | 0.11 | 17.1 | 100 |
| 4 | 15 | 4 | — | 9 | 0.1 | bal | 0.10 | 17.0 | 100 |
| 5 | 15 | 4 | — | 10 | 0.3 | bal | 0.10 | 17.0 | 100 |

The asterisked sample is comparative.
The samples, whose Al content is not specified, contain 0.4 wt % of Al as an impurity.

I claim:

1. An R—Fe—B magnet comprising 11–18 at % R, wherein R is one or more rare-earth elements excluding Dy, with the proviso that at least 80 at % and up to 100 at % of the total R are Nd, Pr or mixtures thereof; 6–12 at % B, and the balance is Fe and Co such that Co is 0–25 at % and impurities.

further comprising V in an amount of from 2 to 6 at % and Cu in an amount of from 0.01 to 1 at %, a V—T—B compound minority phase, wherein T is Fe, Co or mixtures thereof, being finely dispersed in the magnet and the magnet exhibiting a maximum energy product (BH) max of 20 MGOe or more and a coercive force (iHc) of 15 kOe or more.

2. An R—Fe—B sintered magnet according to claim 1, further comprising 3 at % or less of aluminum.

3. An R—Fe—B magnet according to claim 1, further comprising 0–4 at % of one or more of Cr, Mo or W, 0–3 at % of one or more of Nb, Ta, or Ni, and 0–2 at % of one or more of Ti, Zr, Hf, Si or Mn.

4. An R—Fe—B magnet comprising 11–18 at % R, wherein R is one or more rare-earth elements, with the proviso that at least 80 at % and up to 100 at % of the total R are $R_1$, $R_2$ or mixtures thereof, wherein $R_1$ is Nd, Pr or mixtures thereof and $R_2$ is Dy, the content of Dy being 0–4 at % of the magnet; 6–12 at % B, and the balance is Fe and Co such that Co is 0–25 at % or less of the total of Co and Fe and impurities.

further comprising V in an amount of from 2 to 6 at % and Cu in an amount of from 0.01 to 1 at %, a V—T—B compound minority phase, wherein T is Fe, Co or mixtures thereof, being finely dispersed in the magnet and the magnet exhibiting a maximum energy product (BH)max of 20 MGOe or more and a coercive force (iHc) greater than or equal to 15+3x kOe, x being the Dy content of the magnet in at %, with the proviso that when 15+3x exceeds 21, the coercive force of the magnet is 21 kOe or more.

5. An R—Fe—B sintered magnet according to claim 4, further comprising 3 at % or less of aluminum.

6. An R—Fe—B magnet according to claim 4, further comprising 0–4 at % of one or more of Cr, Mo or W, 0–3 at % of one or more of Nb, Ta, or Ni, and 0–2 at % of one or more of Ti, Zr, Hf, Si or Mn.

7. A method for producing a R—Fe—B sintered magnet, which consists essentially of a structure of an $R_2Fe_{14}B$ compound phase and a V—T—B compound minority phase wherein T is Fe, Co or mixtures thereof, the magnet exhibiting a coercive force (iHc) of 15 kOe or more, comprising a step of providing a starting material comprising 11–18 at % R, wherein R is one or more rare-earth elements excluding Dy, with the proviso that at least 80 at % and up to 100 at % of the total R are Nd, Pr or mixtures thereof; 6–12 at % B, 2–6 at % V and 0.01–1 at % Cu, and the balance is Fe and Co such that Co is 0–25 at % and impurities, a sintering step and a step of subsequently heat treating to produce the sintered magnet.

8. A method according to claim 7, wherein the R—Fe—B magnet further comprises 3 at % or less of aluminum.

9. A method according to claim 7, wherein the magnet further comprises 0–4 at % of one or more of Cr, Mo or W, 0–3 at % of one or more of Nb, Ta, or Ni, and 0–2 at % of one or more of Ti, Zr, Hf, Si or Mn.

10. A method for producing a R—Fe—B sintered magnet, which consists essentially of a structure of an $R_2Fe_{14}B$ compound phase and a V—T—B compound minority phase wherein T is Fe, Co or mistures thereof, comprising a step of providing a starting material comprising 11–18 at % R, wherein R is one or more rare-earth elements, with the proviso that at least 80 at % and up to 100 at % of the total R are $R_1$, $R_2$ or mixtures thereof, wherein $R_1$ is Nd, Pr or mixtures thereof and $R_2$ is Dy, the content of Dy being 0–4 at % of the magnet; 6–12 at % B, 2–6 at % V and 0.01–1 at % Cu, and the balance is Fe and Co such that Co is 0–25 at % and impurities, a sintering step and a step of subsequently heat treating to produce the sintered magnet, the magnet exhibiting a coercive force (iHc) of 15+3x kOe or more, where x is the Dy content in at %, with the proviso that when 15+3x exceeds 21, the coercive force of the magnet is 21 kOe or more.

11. A method according to claim 10, wherein the R—Fe—B magnet further comprises 3 at % or less of aluminum.

12. A method according to claim 10, wherein the magnet further comprises 0–4 at % of one or more of Cr, Mo or W, 0–3 at % of one or more of Nb, Ta, or Ni, and 0–2 at % of one or more of Ti, Zr, Hf, Si, or Mn.

13. An R—Fe—B magnet according to claim 2, further comprising 0–4 at % of one or more of Cr, Mo or W, 0–3 at % of one or more of Nb, Ta, or Ni, and 0–2 at % of one or more of Ti, Zr, Hf, Si or Mn.

14. An R—Fe—B magnet according to claim 5, further comprising 0–4 at % of one or more of Cr, Mo or W, 0–3 at % of one or more of Nb, Ta, or Ni, and 0–2 at % of one or more of Ti, Zr, Hf, Si or Mn.

15. A method according to claim 8, wherein the magnet further comprises 0–4 at % of one or more of Cr, Mo or W, 0–3 at % of one or more of Nb, Ta, or Ni, and 0–2 at % of one or more of Ti, Zr, Hf, Si or Mn.

16. A method according to claim 11, wherein the magnet further comprises 0–4 at % of one or more of Cr, Mo or W, 0–3 at % of one or more of Nb, Ta, or Ni, and 0–2 at % of one or more of Ti, Zr, Hf, Si or Mn.

* * * * *